United States Patent [19]

Nittel et al.

[11] 4,368,259

[45] Jan. 11, 1983

[54] COLOR PHOTOGRAPHIC RECORDING MATERIAL CONTAINING AN EMULSIFIED, HYDROPHILIC COLOR-FORMING COMPOUND

[75] Inventors: Fritz Nittel, Leverkusen; Hans Langen, Bonn; Erwin Ranz, Leverkusen, all of Fed. Rep. of Germany

[73] Assignee: Agfa-Gevaert Aktiengesellschaft, Leverkusen, Fed. Rep. of Germany

[21] Appl. No.: 225,383

[22] Filed: Jan. 15, 1981

[30] Foreign Application Priority Data

Jan. 22, 1980 [DE] Fed. Rep. of Germany ..... 3002201

[51] Int. Cl.[3] ..... G03C 1/40

[52] U.S. Cl. ..... 430/546; 430/377; 430/549

[58] Field of Search ..... 430/377, 546, 549

[56] References Cited

U.S. PATENT DOCUMENTS

| | | | |
|---|---|---|---|
| 3,335,011 | 8/1967 | White | 430/546 |
| 3,689,271 | 9/1972 | Nittel et al. | 430/543 |
| 3,764,336 | 10/1973 | Nittel et al. | 430/377 |
| 3,765,897 | 10/1973 | Nittel | 430/512 |
| 4,252,894 | 2/1981 | Viro et al. | 430/546 |

*Primary Examiner*—J. Travis Brown

*Attorney, Agent, or Firm*—Connolly and Hutz

[57] ABSTRACT

Hydrophilic color-forming compounds such as couplers and color-providing compounds for the dye diffusion transfer process may be emulsified with the aid of oil formers when they are in admixture with aliphatic tertiary hydroxy amino compounds as specified hereinafter.

6 Claims, No Drawings

COLOR PHOTOGRAPHIC RECORDING MATERIAL CONTAINING AN EMULSIFIED, HYDROPHILIC COLOR-FORMING COMPOUND

This invention relates to a color photographic recording material which contains an emulsified, hydrophilic color-forming compound in association with at least one photosensitive silver halide emulsion layer.

Hydrophilic color couplers and other color-forming compounds are generally added to photographic casting solutions in the form of an aqueous or aqueous-alcoholic solution. The solutions are prepared with the necessary quantities of alkali unless the coupler is itself present in the form of a water-soluble alkali salt. Hydrophilic color couplers are frequently distinguished by particularly high coupling velocities and, for this reason, are highly desirable in the production of highly sensitive color photographic recording materials, However, the incorporation of hydrophilic compounds into photographic layers from aqueous-alkaline solution involves serious disadvantages, insofar as the high salt content of the emulsion brought about by neutralization of the alkaline solutions stops the materials from staying flat and makes them extremely brittle. In addition, the casting solutions generally have to be heavily diluted with water in order to compensate for the increase in viscosity brought about by the reaction of the sulfo groups or carboxyl groups with the amino groups in the gelatin. This results in a relatively high wet application of the layers during casting which in turn makes the layers very expensive to dry. In addition, layers having a desirably high packing density of color couplers or other color-forming compounds are extremely difficult to obtain by this method.

There has been no shortage of attempts to use the method of incorporating by emulsification known from the incorporation of hydrophobic couplers for hydrophilic compounds, but unfortunately this has not yet been satisfactorily possible on account of the poor solubility of hydrophilic couplers, for example, in organic solvents and auxiliary solvents. In the method described in German Offenlegungsschrift No. 2,647,487, hydrophilic couplers are dissolved together with bis-epoxides in oil formers and the resulting solution is dispersed in the silver halide emulsion in the presence of wetting agents. Although it is possible in this way to incorporate hydrophilic couplers by emulsification, it is not possible to prevent the undesirable increase in viscosity of the casting solution because the bis-epoxides used are gelatin hardeners and react with the amino groups of the gelatin, which also brings about an increase in viscosity.

The object of the present invention is to provide a color photographic recording material which contains hydrophilic color-forming compounds without having any of the disadvantages referred to above.

According to the invention, this object is achieved by a color photographic recording material containing at least one photosensitive silver halide emulsion layer and, associated therewith, a nondiffusing hydrophilic color-forming compound, which is characterised in that the photosensitive silver halide emulsion layer or a non-photosensitive binder layer adjacent thereto contains a dispersion of a solution of a hydrophilic color-forming compound and an aliphatic tertiary hydroxy amine, in which at least two of the aliphatic groups present contain a hydroxyl group, in an oil former.

Preferred aliphatic tertiary hydroxy amines correspond to formula (I) below

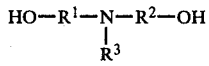

$$HO-R^1-\underset{\underset{R^3}{|}}{N}-R^2-OH \qquad (I)$$

in which $R^1$ and $R^2$ which may be the same or different, represent alkylene groups preferably containing from 1 to 4 carbon atoms which may be interrupted by oxygen atoms;

$R^3$ represents a $C_1$–$C_{18}$—, preferably $C_1$–$C_4$— alkyl or alkenyl group which may be interrupted by oxygen atoms and which may be substituted by a hydroxyl group.

The above-mentioned alkylene groups ($R^1$, $R^2$) and the alkyl or alkenyl groups ($R^3$) may be linear or branched chain and may contain, for example, lateral methyl groups. The alkylene radicals represented by $R^1$ and $R^2$ are preferably alkylene radicals of the type derived from the addition of ethylene oxide or propylene oxide to ammonia or primary amines $R^1$-$NH_2$.

Particularly suitable examples of aliphatic tertiary hydroxy amines (HA) are shown in the following:

butyl-bis-(2-hydroxyethyl)-amine HA-1

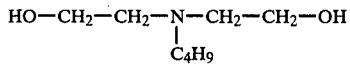

$$HO-CH_2-CH_2-\underset{\underset{C_4H_9}{|}}{N}-CH_2-CH_2-OH$$

bis-(2-hydroxyethyl)-oleylamine HA-2

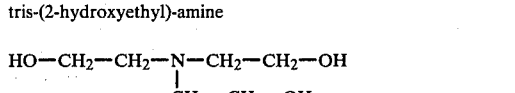

$$HO-CH_2-CH_2-\underset{\underset{CH_2-(CH_2)_7-CH=CH-(CH_2)_7-CH_3}{|}}{N}-CH_2-CH_2-OH$$

tris-(2-hydroxyethyl)-amine HA-3

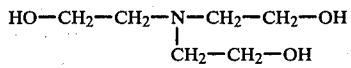

$$HO-CH_2-CH_2-\underset{\underset{CH_2-CH_2-OH}{|}}{N}-CH_2-CH_2-OH$$

tris-[2-(2-hydroxyethoxy)-ethyl]-amine HA-4

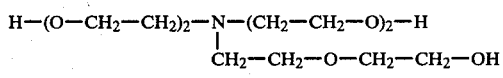

$$H-(O-CH_2-CH_2)_2-\underset{\underset{CH_2-CH_2-O-CH_2-CH_2-OH}{|}}{N}-(CH_2-CH_2-O)_2-H$$

bis-(2-hydroxypropyl)-methylamine HA-5

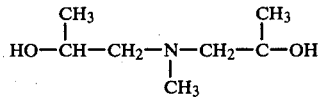

$$HO-\overset{\overset{CH_3}{|}}{CH}-CH_2-\underset{\underset{CH_3}{|}}{N}-CH_2-\overset{\overset{CH_3}{|}}{C}-OH$$

tris-(2-hydroxypropyl)-amine HA-6

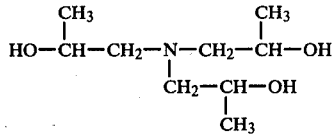

$$HO-\overset{\overset{CH_3}{|}}{CH}-CH_2-\underset{\underset{CH_2-\underset{\underset{CH_3}{|}}{CH}-OH}{|}}{N}-CH_2-\overset{\overset{CH_3}{|}}{CH}-OH$$

2-hydroxyethyl-bis-(2-hydroxypropyl)-amine HA-7

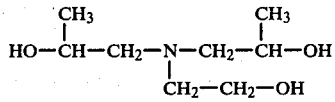

$$HO-\overset{\overset{CH_3}{|}}{CH}-CH_2-\underset{\underset{CH_2-CH_2-OH}{|}}{N}-CH_2-\overset{\overset{CH_3}{|}}{CH}-OH$$

The aliphatic tertiary hydroxy amines used in accordance with the invention are known compounds which are reported for example in Beilstein (Syst. No. 353 and 354).

The color photographic recording material according to the invention generally contains at least three differently spectrally sensitized silver halide emulsion layer units of which each in turn may consist of one silver halide emulsion layer or of several component silver halide emulsion layers. In association with the individual silver halide emulsion layers, the color photographic recording material according to the invention contains color-forming compounds, i.e. compounds which produce image dyes during the photographic development process. Compounds such as these are understood to be both conventional color couplers and also color-providing compounds of the type which, during development, yield diffusing image dyes of their precursors which, after a diffusion transfer, produce a dye image in an image-receiving layer. The couplers and color-providing compounds are in practice selected in such a way that the image dyes produced during processing have a color which is substantially complementary to the color of the light to which the associated silver halide emulsion layers are sensitive. Accordingly, the color-forming compounds associated with the red-sensitive layers give cyan image dyes, the color-forming compounds associated with the gree-sensitive layers give magenta image dyes and the color-forming compounds associated with the blue-sensitive layers give yellow image dyes.

In the context of the invention, the terms "association" and "associated" are understood to mean that the mutual arrangement of the silver halide emulsion layer and the color-providing compound or coupler is such as to make possible an interaction between them which provides for an image-wise coincidence between the silver image formed or the image-wise distribution of the undeveloped silver halide on the one hand and, on the other hand, the image-wise distribution of image dye formed. This result is generally obtained by incorporating the color-providing compound or coupler either directly in a photosensitive silver halide emulsion layer or in a non-photosensitive binder layer adjacent thereto. Separation layers which may contain substances which are capable of reacting with secondary development products and rendering them harmless may be arranged between silver halide emulsion layer units of different spectral sensitivity containing at least one silver halide emulsion layer and at least one color-forming compound associated therewith.

In order to maintain the above mentioned associations, it is also of advantage to introduce the color-forming compounds into the particular layers in non-diffusing form. This may be done by any of the usual methods of incorporation, hydrophilic compounds largely being added in the form of aqueous alkali solutions and hydrophobic compounds, largely being added in emulsified form using oil formers. According to the invention, the color photographic recording material now contains a non-diffusing hydrophilic color-forming compound in emulsified form in association with at least one silver halide emulsion layer.

In the context of the invention, those color-forming compounds are understood to be "hydrophilic" which on account of the presence in them of groups imparting solubility in alkalis, have a level of solubility in the organic auxiliary solvents used during incorporation, such as ethanol, ethyl acetate, diethyl carbonate, and above all in the oil formers in question, which is too low to enable stable emulsions to be formed. In the final emulsion or in emulsified form in the cast layer, if it is actually possible to obtain them in organic solution, these couplers generally have an excessively high tendency towards crystallization which is reflected in clouding of the layer and in a distinct deterioration in the photographic properties, particularly the maximum obtainable color density. By means of the tertiary aliphatic hydroxy amines used in accordance with the invention, which presumably react with the alkali-solubilizing groups to form tertiary organic ammonium salts, it is possible distinctly to reduce the hydrophilicity of the color-forming compounds and hence decisively to improve the stability in the organic auxiliary solvents and the oil former. Particularly suitable hydrophilic color-forming compounds are those which contain in their molecule a sulfo group and/or one or more other alkali-solubilizing groups, such as carboxyl groups (—COOH) or sulfonamide groups (—NH—$SO_2$—).

Hitherto, it has only been possible with difficulty, if at all, to incorporate color-forming compounds of this type in emulsified form. The incorporation method according to the invention is equally suitable for the incorporation of non-diffusing color couplers from which non-diffusing image dyes are produced after chromogenic development, and for non-diffusing color-providing compounds for the dye diffusion transfer process from which diffusing dyes are released during photographic processing.

The color couplers used in accordance with the invention may be both standard 4-equivalent couplers and also 2-equivalent couplers, in the case of which a small quantity of silver halide is required for dye production. It is known that 2-equivalent couplers may be derived from the 4-equivalent couplers because they contain, in the coupling position, a substituent which is split off during the coupling reaction. 2-Equivalent couplers which may be used in accordance with the present invention are both those which are substantially colorless and also those which have an intense natural color whch disappears during color coupling or which is replaced by the color of the image dye produced. According to the invention, the latter couplers may also additionally be present in the photosensitive silver halide emulsion layers where they act as masking couplers for compensating the undesirable secondary densities of the image dyes. The 2-equivalent couplers also include the known white couplers which, however, do not produce a dye on reaction with color developer oxidation products. Other 2-equivalent couplers include the known DIR couplers, i.e. couplers which, in the coupling position, contain a releasable radical which is released as a diffusing development inhibitor on reaction with color developer oxidation products.

The non-diffusing, color-providing compounds releasing diffusing dyes which may also be incorporated by the method according to the invention are compounds in which a potentially diffusible dye or dye precursor residue is fixed to a carrier residue encumbered by a group imparting resistance to diffusion. Through the presence of a sulfo group or of one or two other alkali-solubilizing groups, compounds such as these are so hydrophilic that they cannot be emulsified by the usual methods. The above-mentioned carrier residues are of such a type that they release a diffusing dye residue either predominantly in oxidized form or predominantly in non-oxidized form or in consequence of a coupling reaction with developer oxidation products. Concerning color-providing of this type, reference should be made to U.S. Pat. Nos. 3,227,550; 3,245,789; 3,443,940; 3,628,952; 3,928,312; 3,980,479 and 3,139,379 and to German Offenlegungsschriften Nos. 2,505,248 and 2,645,656.

The following compounds are mentioned as examples of hydrophilic color-forming compound (CP) which, according to the invention, may be present in emulsified form in the layers of the color photographic recording material:

CP-1

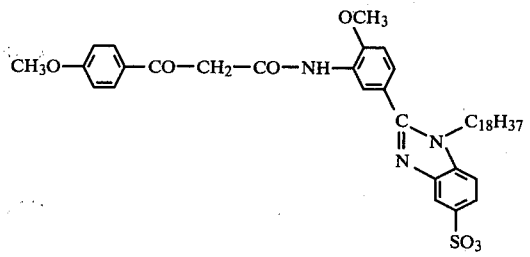

CP-2

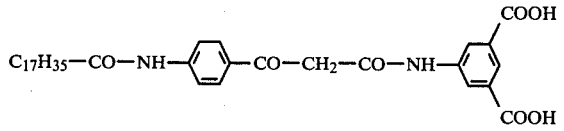

CP-3

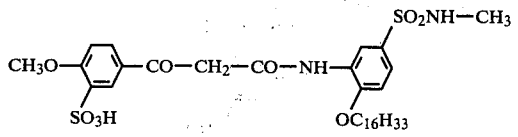

CP-4

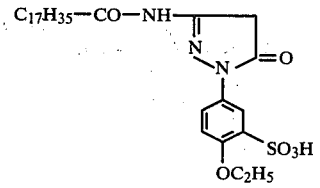

CP-5

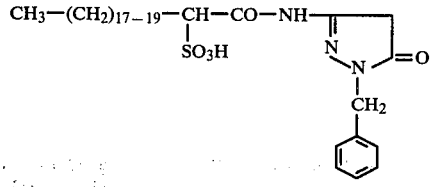

CP-6

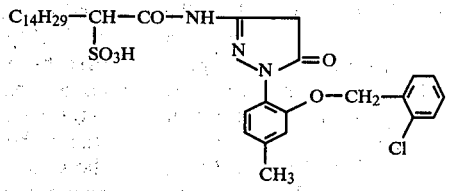

CP-7

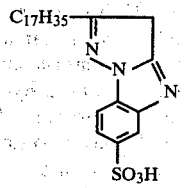

CP-8

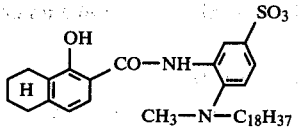

-continued

CP-9

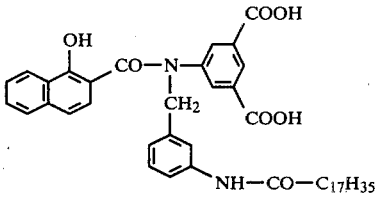

CP-10

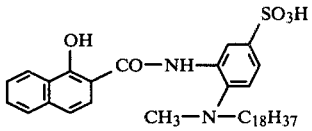

CP-11

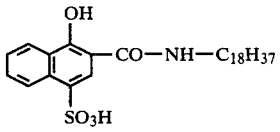

CP-12

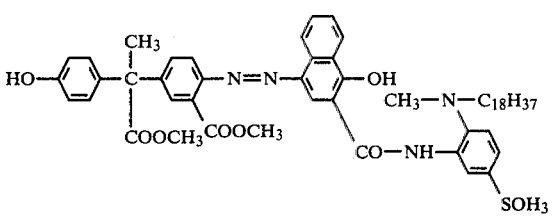

CP-13

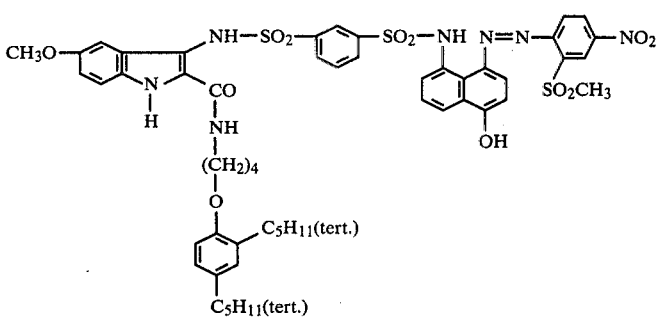

Suitable oil formers are the usual, more or less hydrophobic high-boiling compounds also known as coupler solvents of the type described, for example, in U.S. Pat. No. 2,322,027. Particular reference is made here for example to dibutyl phthalate (OF-1) and tricresyl phosphate (OF-2). It is also possible, with advantage, to use oil formers containing carboxyl groups, for example the succinic acid derivatives containing at least one carboxyl group according to U.S. Pat. Nos. 3,689,271; 3,764,336 and 3,765,897. Examples of oil formers such as these are given hereinafter as oil formers OF-3 to OF-10. Although the oil formers when they contain carboxylic groups may also have a distinctly hydrophilic character as the example of the last-mentioned compounds shows, it is a common feature of all oil formers that, on incorporation into a hydrophilic colloid binder, they form therein a second separate phase in the form of small droplets which remains intact in the alkaline medium, even under the conditions of photographic development. For incorporating the hydrophilic color forming compounds, the oil formers are used in a quantity of from 0.1 to 2 parts by weight and preferably in a quantity of about 1 part by weight per part by weight of hydrophilic color-forming compound. According to the invention, particular advantages are obtained when the oil former used contains a free carboxyl group and has a molecule which in part shows a certain structural similarity to the tertiary aliphatic hydroxy amines used in accordance with the invention. Oil formers such as these which are used with particular preference in accordance with the invention may be obtained by reacting α-alkyl succinic acid anhydride with tertiary aliphatic hydroxy amines corresponding to formula (I). Oil formers of this type are also described in U.S. Pat. No. 3,689,271.

Examples of oil formers such as these are given in the following list of formulae as oil formers OF-3 to OF-8.

Oil Fomer:

dibutyl phthalate OF-1

-continued

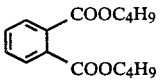

tricresyl phosphate OF-2

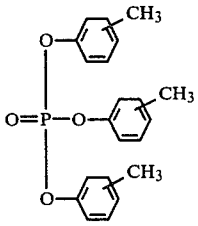

OF-3

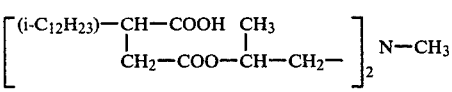

OF-4

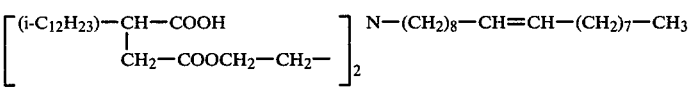

OF-5

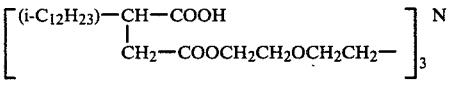

OF-6

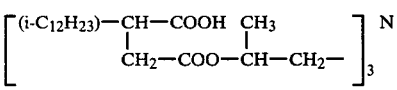

OF-7

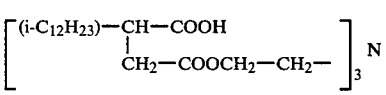

OF-8

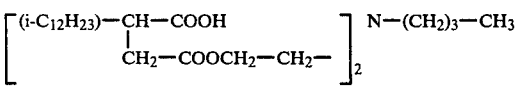

OF-9

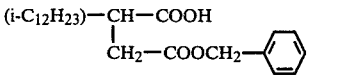

OF-10

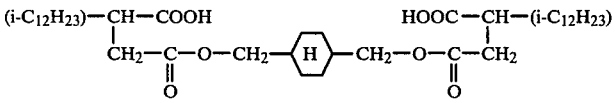

i—$C_{12}H_{23}$ represents a tetrapropenyl or triisobutenyl radical which may be present in admixture with one another. However, this radical may be replaced by other long-chain hydrocarbon radicals, for example i—$C_{15}H_{29}$ or i—$C_{18}H_{35}$-radicals.

To produce the color photographic recording material according to the invention which contains hydrophilic color-forming compounds in emulsified form, the color-providing compounds or couplers together with at least one compound corresponding to formula (I) and the oil former in question, are preferably initially dissolved in an organic auxiliary solvent, such as ethanol, ethyl acetate, diethyl carbonate, acetone or a mixture thereof. One example of a mixture which has proved to be favourable is a mixture of 80 parts of ethyl acetate and 20 parts of ethanol or a mixture of 80 parts of diethyl carbonate and 20 parts of ethanol. The quantity of tertiary aliphatic hydroxy amine required generally depends upon the number of alkali-solubilizing groups in the hydrophilic color-forming compound and may readily be determined by simple tests. Optimum results are obtained for example when the tertiary aliphatic hydroxy amine is used in 0.5 to 2 times the molar quantity, based on the hydrophilic color-forming compound used. The oil former is employed in a quantity of from 0.1 to 2 parts by weight per part by weight of hydrophilic color forming compound. The organic solution obtained is emulsified by standard methods in a hydrophilic colloid, for example in a silver halide emulsion, or in a gelatin solution which may be subsequently added to a silver halide emulsion or which is itself cast to form a non-photosensitive layer, optionally after the addition of other substances.

The use of the tertiary aliphatic hydroxy amines facilitates the incorporation of hydrophilic color forming compounds in emulsified form. Accordingly, the invention also makes it possible for hydrophilic and hydrophobic color-forming compounds, for example hydrophilic and hydrophobic color couplers, to be used alongside one another in the form of a common emulsion.

EXAMPLE 1

(a) 20 g of the red masking coupler CP-12 were taken up in a mixture of 80 ml of ethyl acetate and 4 g of triisopropanolamine (HA-6). In addition, 20 g of tricresyl phosphate (OF-2) and 1.3 g of a 75% paste of sodium dodecyl benzene sulfonate were added. After heating to 50° C., the solution obtained was emulsified in 800 ml of a 5% aqueous gelatin solution which had also been heated to 50° C. Removal of the ethyl acetate in a thin-layer evaporator left a dispersion which was quite fluid at 40° C. and which could be distributed completely homogeneously in a silver halide emulsion.

(b) For comparison, the same coupler CP-12 was added to an emulsion in the form of an aqueous solution. This was only possible with a solution having a coupler concentration of less than 1% by weight for a pH-value of 7 (in the form of the sodium salt).

EXAMPLE 2

(a) 3 g of the color-providing compound CP-13 forming a cyan dye were taken up in a mixture of 15 ml of ethyl acetate, 1.7 g of triisopropanolamine (HA-6) 3 g of diethyl lauramide and 0.2 g of a 75% paste of sodium dodecyl benzene sulfonate. The resulting solution was heated to 60° C. and emulsified in 60 ml of a 5% gelatin solution which had been heated to 40° C. After removal of the residual ethyl acetate in a rotary evaporator, the dispersion obtained had a stability in storage at 6° C. of several weeks.

(b) For comparison, 3 g of the color-providing compound CP-13 were dissolved with heating in a mixture of 7.5 ml of tetrahydrofuran and 7.5 ml of ethyl acetate. After the addition of 3 g of diethyl lauramide and 0.2 g of sodium dodecyl sulfonate (75%), the solution heated to 60° C. was emulsified in 60 ml of a 5% gelatin solution. After the dispersion obtained had stood for several hours, crystals were precipitated.

(c) Again for comparison, the procedure described in (b) was repeated using 3 ml of dimethyl formamide and 15 ml of ethyl acetate as auxiliary solvent. After evaporation of the auxiliary solvent, the dispersion obtained showed distinct signs of crystallisation and, after a few days, was infusible.

EXAMPLE 3

Various dispersions were prepared by the method described in detail for dispersion 3.1:

3.1.

50 g of the yellow coupler CP-3 were dissolved in a mixture of 160 g of diethyl carbonate, 40 g of ethanol, 10 g of water, 14 g of triisopropanolamine (HA-6) and 50 g of dibutyl phthalate (OF-1). The solution was stable at room temperature and did not show any signs of recrystallisation. The solution obtained was emulsified at 45° C. in 1000 ml of a 5% aqueous gelatin solution in the presence of 0.5 g of sodium dodecyl sulphate. The auxiliary solvent was evaporated off.

3.2

50 g of tricresyl phosphate (OF-2) were used as oil former in otherwise the same procedure as adopted for 3.1.

3.3

50 g of the compound OF-6 were used as oil former in otherwise the same procedure as adopted for 3.1.

3.4

50 g of the compound OF-7 were used as oil former in otherwise the same procedure as adopted for 3.1.

3.5

50 g of the compound OF-9 were used as oil former in otherwise the same procedure as adopted for 3.1.

3.6

50 g of the compound OF-10 were used as oil former in otherwise the same procedure as adopted for 3.1.

3.7

11 g of the compound HA-3 were used instead of the compound HA-6 in otherwise the same procedure as adopted for 3.1.

3.8

13 g of the compound HA-7 were used instead of the compound HA-6 in otherwise the same procedure as adopted for 3.1.

In order to study viscosity behaviour during digestion at 40° C., 1 kg of each of the dispersions obtained was mixed with 780 g of a silver halide emulsion (gelatin content 7.5%). The viscosities observed are shown in Table 1 below. A casting solution (test 3.9) which had been obtained by mixing 374 ml of a 10% aqueous-alkaline solution of the yellow coupler CP-3 and 636 g of a silver halide emulsion (gelatin content 7.5%), was used for comparison. The measured viscosities [mPa.s] of the casting solutions immediately after preparation and after digestion for 3 and 6 hours at 40° C. are shown in Table 1 below:

TABLE 1

| | Viscosity [mPa.s] | | |
|---|---|---|---|
| Test | fresh | 3 hours | 6 hours |
| 3.1 | 99.0 | 96.0 | 93.5 |
| 3.2 | 99.5 (96) | 93.0 (94) | 80.0 (86) |
| 3.3 | 92.5 (92) | 81.0 (89) | 80.0 (85) |
| 3.4 | 83.0 | 81.5 | 80.0 |
| 3.5 | 87.0 (98) | 84.5 (92) | 80.0 (88) |
| 3.6 | 89.0 | 85.5 | 83.0 |
| 3.7 | 98.5 | 94.0 | 82.0 |
| 3.8 | 99.0 | 93.5 | 81.5 |
| 3.9 | 102.0 (106) | 106.5 (152) | 135.0 (a*) |

a* = not measurable

With the exception of comparison test 3.9 using the alkali-dissolved coupler, all the casting solutions show a normal viscosity trend, i.e. slightly diminishing values attributable to slight gelatin degradation. The increase in viscosity observed in test 3.9 leads to disturbances during coating because casting solutions often have to stand for between 6 and 12 hours between preparation and casting.

The bracketed values in Table 1 are viscosity values which were measured in the same way on the pure dispersions (without addition of the silver halide emulsion). For comparison, 200 ml of a 5% aqueous-alkaline solution of the coupler CP-3 were mixed with 100 ml of a 10% gelatin solution in the case of the alkali-dissolved coupler (test 3.9); pH 6.4.

Table 2 shows the maximum color densities of various photographic materials which had been obtained with the above-described emulsions 3.1 to 3.8 by mixing with a silver bromide emulsion (ratio of silver nitrate to coupler = 1:1.5) and casting onto a paper support. Development was carried out in the usual way using N-butyl-N-ω-sufobutyl-p-phenylene diamine as the developer substance. For comparison (3.9), a corresponding material was prepared with the alkali-dissolved coupler CP-3. One sample of each of the materials thus prepared was exposed and developed in its fresh state and a second sample after storage (for 2 days at 60° C./60% relative air humidity). The maximum color density Dmax and the loss of density Δ Dmax during storage are shown in Table 2.

TABLE 2

| Test | Dmax | Δ Dmax [%. (−1)] |
|---|---|---|
| 3.1 | 2.25 | 13.3 |
| 3.2 | 2.30 | 10.0 |
| 3.3 | 2.35 | 7.2 |
| 3.4 | 2.35 | 6.8 |
| 3.5 | 2.25 | 9.3 |
| 3.6 | 2.30 | 12.2 |
| 3.7 | 2.25 | 11.1 |
| 3.8 | 2.20 | 10.0 |
| 3.9 | 1.85 | 39.5 |

EXAMPLE 4

Emulsion of a hydrophilic and a hydrophobic yellow coupler.

The quantities indicated in Table 3 below of triisopropanolamine (HA-6), yellow coupler X and yellow coupler CP-3 were taken up in a mixture of 100 g of diethyl carbonate, 40 g of ethanol, 10 g of water and 50 g of tricresyl phosphate (OF-2).

Yellow coupler X is a hydrophobic yellow coupler corresponding to the following formula:

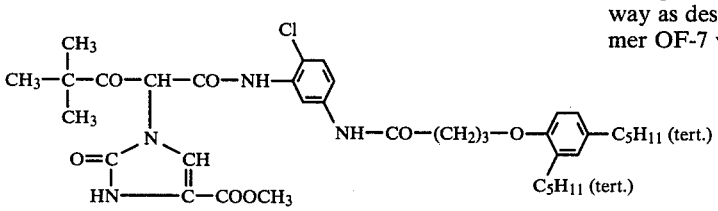

The oil phase obtained was emulsified in 1000 ml of a 5% gelatin solution containing 0.5 g of sodium dodecyl benzene sulfate, the resulting emulsion was mixed with a silver halide emulsion (ratio of silver nitrate to coupler adjusted to 1:1.5) and the resulting mixture cast onto a paper support; silver coating 0.54 g of $AgNO_3/m^2$. After exposure and color processing in the usual way, the maximum color densities shown in Table 3 were measured.

TABLE 3

| Test | Hydroxy amine HA-6 | Yellow coupler CP-3 | Yellow coupler X | Dmax |
|---|---|---|---|---|
| 4.1 | — | — | 50 g | 1.50 |
| 4.2 | 0.7 g | 2.5 g | 47.5 g | 1.67 |
| 4.3 | 1.4 g | 5.0 g | 45 g | 1.88 |
| 4.4 | 2.8 g | 10 g | 40 g | 2.36 |
| 4.5 | 4.2 g | 15 g | 35 g | 2.32 |

In this Example, an optimal color yield is obtained with a coupler ratio of 20:80 (hydrophilic/hydrophobic).

EXAMPLE 5

Emulsion of a hydrophilic and a hydrophobic magenta coupler:

5.1 (Comparison)

50 g of the hydrophobic coupler Y were dissolved in 160 ml of diethyl carbonate and 50 g of tricresyl phosphate (OF-2). The solution obtained was emulsified in 500 ml of a 10% gelatin solution with addition of 25 ml of a 10% solution of sodium alkyl naphthalene sulphonate.

The hydrophobic coupler Y has the following formula

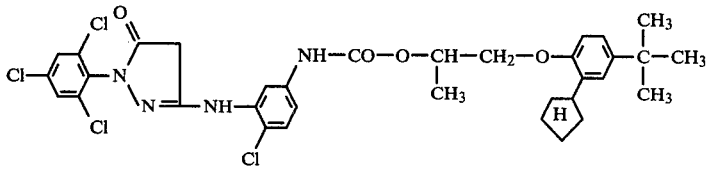

After evaporation of the solvent, the emulsion was mixed with a silver bromide emulsion (ratio of silver nitrate to coupler 1:0.7) and the resulting mixture case onto a paper support. Silver coating: 0.46 g of $AgNO_3/m^2$.

5.2

35 g of the hydrophobic coupler Y, 15 g of the hydrophilic coupler CP-5 and 6 g of the compound according to the invention HA-6 were dissolved, emulsified in gelatin and cast onto a paper support in the same way as described in 5.1.

5.3

A photographic material was prepared in the same way as described in 5.2, except that 50 g of the oil former OF-7 were used instead of tricresyl phosphate.

After exposure and colour processing in the usual way (color developer: N-butyl-N-ω-sulfobutyl-p-phenylene diamine), the maximum color densities shown in Table 4 were measured.

TABLE 4

| Test | Dmax |
|---|---|
| 5.1 | 1.31 |
| 5.2 | 2.02 |
| 5.3 | 2.27 |

We claim:

1. A color photographic recording material comprising at least one photosensitive silver halide emulsion layer and, associated therewith, a non-diffusing hydrophilic color-forming compound, wherein the improvement comprises the photosensitive silver halide emulsion layer or a non-photosensitive binder layer adjacent thereto contains a stable dispersion of a solution of a hydrophilic dye producing compound and an aliphatic tertiary hydroxy amine, in which at least two of the aliphatic groups present contain a hydroxyl group, in a hydrophobic oil former.

2. A recording material as claimed in claim 1, in which the aliphatic tertiary hydroxy amine corresponds to the following formula:

$$HO-R^1-\underset{\underset{R^3}{|}}{N}-R^2-OH \qquad (I)$$

in which $R^1$ and $R^2$ are the same or different and prepresent alkylene groups containing from 1 to 4 carbon atoms which may be interrupted by oxygen atoms, and $R^3$ represents an alkyl or alkenyl group containing from 1 to 18 carbon atoms which may be interrupted by oxygen atoms and which may be substituted by a hydroxyl group.

3. A recording material as claimed in claim 1, in which the hydrophilic color-forming compound contains a sulfo group and/or one or two carboxyl groups (—COOH) or sulfonamide groups (—NH—$SO_2$—).

4. A recording material as claimed in claim 1, in which the aliphatic tertiary hydroxy amine is used in 0.5 to 2 times the molar quantity, based on the hydrophilic color-forming compound.

5. A recording material as claimed in claim 1, in which the hydrophilic color-forming compound is a hydrophilic color coupler.

6. A recording material as claimed in claim 5, in which in addition to the hydrophilic color coupler and the aliphatic tertiary hydroxy amine, a hydrophobic color coupler is dissolved in the oil former.

* * * * *